US006641277B2

(12) United States Patent
Smith

(10) Patent No.: US 6,641,277 B2
(45) Date of Patent: Nov. 4, 2003

(54) TACTICAL LIGHT

(76) Inventor: Phillip L. Smith, 16566 Jones Rd., Grand Ledge, MI (US) 48837

( * ) Notice: Subject to any disclaimer, the term of this patent is extended or adjusted under 35 U.S.C. 154(b) by 53 days.

(21) Appl. No.: 09/960,190

(22) Filed: Sep. 21, 2001

(65) Prior Publication Data

US 2003/0058636 A1 Mar. 27, 2003

(51) Int. Cl.[7] ..... F41G 1/34

(52) U.S. Cl. ..... 362/111; 362/110; 362/114; 42/146

(58) Field of Search ..... 362/110, 111, 362/114, 113, 190, 191, 401, 112, 109, 205, 262; 42/146, 132

(56) References Cited

U.S. PATENT DOCUMENTS

| | | | | | |
|---|---|---|---|---|---|
| 2,597,565 | A | * | 5/1952 | Chandler et al. | 362/111 |
| 5,167,446 | A | * | 12/1992 | Haroutunian | 362/110 |
| 5,743,623 | A | * | 4/1998 | Kerr | 362/190 |
| 2002/0100204 | A1 | * | 8/2002 | Kim | 42/146 |

* cited by examiner

*Primary Examiner*—Sandra O'Shea
*Assistant Examiner*—Bao Truong
(74) *Attorney, Agent, or Firm*—Ian C. McLeod

(57) ABSTRACT

A tactical light particularly adapted for use by duly authorized armed civilians, police officers and military personnel. The tactical light incorporates structure that facilitates a two hand full combat grip on a weapon, such as a pistol or revolver, while using the tactical light.

9 Claims, 6 Drawing Sheets

TACTICAL LIGHT

BRIEF SUMMARY OF THE INVENTION

This invention relates to artificial lights and, more particularly, to an improved tactical light particularly adapted for use by duly authorized armed civilians, police officers and military personnel, it being understood that the present invention is also applicable for use by others.

As is well known in the art, when a duly authorized armed civilian, police officer or military personnel faces a combat confrontation in dim light or darkness, the chances of survival are greatly increased with the use of artificial light. The artificial lights most often used are the common barrel-style flashlight or special, specific purpose combat lights often referred to in the art as tactical lights. A common feature of a tactical light is a very bright concentrated light beam produced by a pre-focused incandescent lamp assembly. The present invention is embodied in a tactical light.

The primary purposes of a tactical light are searching and identification of a threat. The main problem with current flashlight and tactical light techniques is the inability to use a full combat grip on a weapon while holding the light in conduction with a weapon thereby leading to problems recovering from recoil for both the light and the weapon. Heretofore, the most popular way to use a flashlight with a weapon while using a full combat grip on the weapon is with a weapon mounted flashlight. Weapon mounted flashlights require that the search with the flashlight and the identification of the threat be done while the barrel of the loaded weapon sweeps over the area. Many police departments, for example, consider it inappropriate and undesirable to sweep and search with a loaded weapon and they only want a weapon pointed at a subject when it is tactically necessary.

As is well known in the art, the current flashlight/weapon techniques are known as the Harris Technique, the Chapman Technique, the FBI Technique and the Rogers (Surefire) Technique. None of these techniques allow a full combat grip on a pistol, for example, while using the flashlight. Some persons attempt a body-adjustment technique to approximate, as close as possible, a limited full combat grip on the weapon. The fully combat grip on the weapon is a tactical shooting technique taught by many of the private shooting academies and most police training schools. The reason it is taught is because it is the foundation of accurate shot placement and recoil control of a pistol. The hand which holds the weapon is called the strong hand, while the hand which wraps around the strong hand is called the support hand.

The present invention addresses, inter alia, three main problems of existing flashlight techniques: (1) the inability to allow a full combat grip on a pistol; (2) the potentially dangerous method of sweeping with the loaded weapon with the weapon-mounted systems; and (3) the loss of control of both the light and the gun from recoil. The present invention is embodied in a tactical light and its use is primarily combat confrontation. Tactical lights embodying the present invention can be easily carried over a belt or a duty-belt, and do not require an additional holster. When in use held by the support hand, tactical lights embodying the present invention stay on the hand thereby allowing the support hand and the fingers thereof to open doors, for example, as well as to complete other minor tasks without having to tuck the flashlight under the arm, set it down, or put it in a holster.

Tactical lights embodying the present invention have a light control switch which can be placed in the off position, in the on position for a constant light beam or in the switch position for intermittent use with a touch-pad switch. When the operator wishes to assume a full combat grip, the support hand is simply brought up to the strong hand and the strong hand knuckles fit into a ridged cantilever handle provided on the tactical light in accordance with the present invention. With the full combat grip, the support hand index finger controls the touch-pad switch which allows the operator to choose whether tactical lights embodying the present invention are on or off.

When employed with a full combat grip, the present invention keeps the light beam axis parallel with the axis of the weapon barrel and since the tactical light is immediately under and touching the weapon, does not allow the light to illuminate the front sights of the weapon. The shape of tactical lights embodying the present invention prevents the tactical light from rolling around if set down for any reason, even on a sloped grade. The present invention thus provides for a small and light weight package and eliminates the potential problems of using heavy barrel style flashlights with weapons.

The most common use of a flashlight in law enforcement is routine searching in dim light or darkness. Problems with prior art flashlight techniques arise when a "transition" from searching to combat confrontation is required. The present invention enables a fast and uncomplicated transition from a support hand hold of the tactical light to a full combat grip since the essence of the present invention is its natural inclusion in the full combat grip. Since tactical lights embodying the present invention are held tight to the bottom side of the weapon (trigger guard) and is included (rather than suspended) in the full combat grip, recovery from recoil is as fast for the present invention as it is for the weapon fired. Quick recovery from recoil allows the light beam to be set back on target after its original track is upset by the recoil of the weapon.

An object of the present invention is to overcome disadvantages in prior flashlights of the indicated character, and to provide an improved tactical light that facilitates a two hand full combat grip on a weapon, such as a pistol or revolver, while using the tactical light.

Another object of the present invention is to provide an improved tactical light which enables the user thereof to open doors, for example, and to subdue or handcuff a person without letting go of the light.

Another object of the present invention is to provide an improved tactical light which can be used with one hand or with a two hand full combat grip.

Another object of the present invention is to provide an improved tactical light which eliminates the need for a holster as well as the need for a keeper or lanyard.

Another object of the present invention is to provide an improved tactical light which does not require the user thereof to change or disrupt grips or require the user thereof to cross wrists.

Another object of the present invention is to provide an improved tactical light which enables the user thereof to write on a clipboard in the dark, for example, without requiring the user to hold a flashlight in the mouth.

Another object of the present invention is to provide an improved tactical light which uses standard batteries and which is water tight and body fluid tight thereby enabling the light to be easily washed and disinfected.

Another object of the present invention is to provide an improved tactical light which does not require the user thereof to change drawing techniques at night and which enables the support hand to meet the gun hand whereby both the tactical light and the gun are pushed toward the target at the same time.

Another object of the present invention is to provide an improved tactical light which can be easily turned on and off simply by pressing the support hand index finger to engage a touch-pad switch so that the tactical light is only on when it is desired or necessary.

Another object of the present invention is to provide an improved tactical light which enables the user thereof to go from a traffic stop, for example, to a full combat grip in record time.

Another object of the present invention is to provide an improved tactical light which enables the user thereof to climb, push, pull, restrain or handcuff without releasing the tactical light.

Another object of the present invention is to provide an improved tactical light which enables the user thereof to speedily reload an associated gun without removing the light from the user's hand.

Another object of the present invention is to provide an improved tactical light which facilitates fast shut-off of the light so as to avoid mirror or reflective surface flashback while clearing a premise, for example.

Another object of the present invention is to provide an improved tactical light wherein in use the light beam is on an axis parallel with the axis of the barrel of an associated pistol, revolver or other weapon.

Another object of the present invention is to provide an improved tactical light which is economical to manufacture and assemble, durable, efficient and reliable in operation.

The above as well as other objects and advantages of the present invention will become apparent from the following description, the appended claims and the occupying drawings.

DETAILED DESCRIPTION

Figure 1:
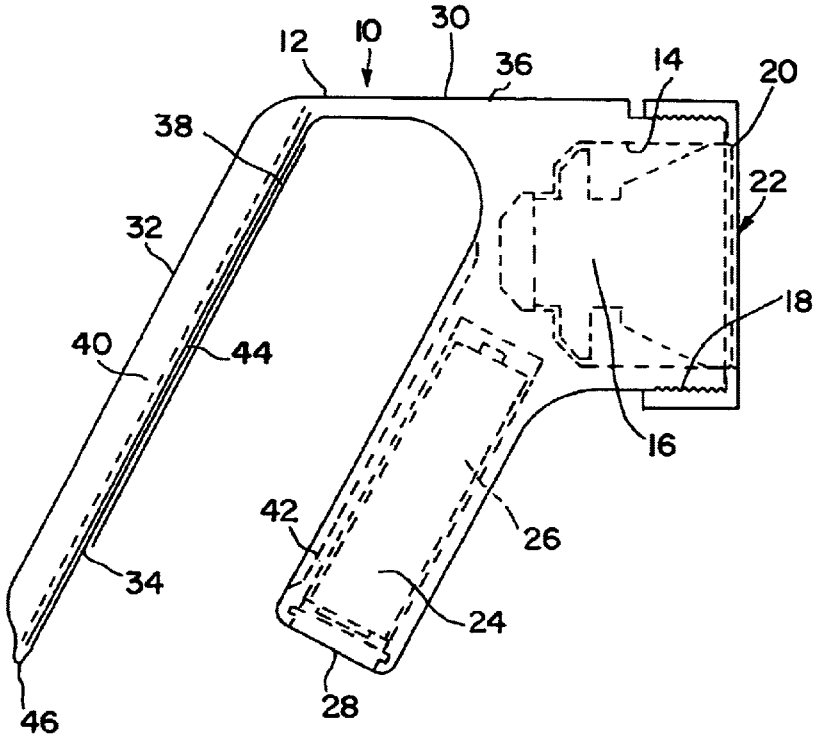
FIG. 1 is a schematic side elevational view of a tactical light embodying the present invention.
Figure 2:
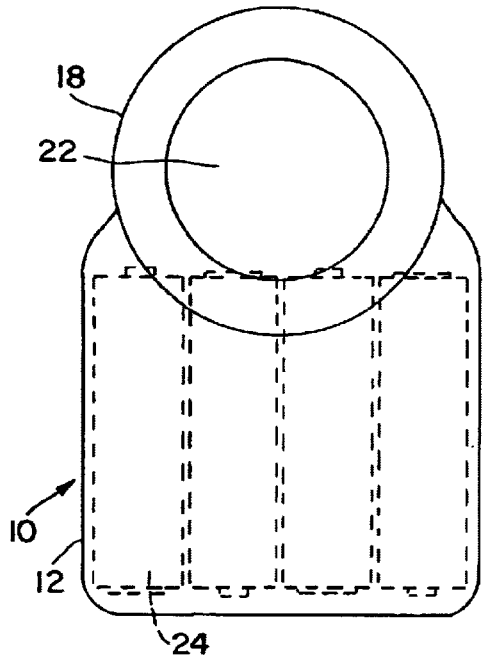
FIG. 2 is a front view of the structure illustrated in FIG. 1.
Figure 3:
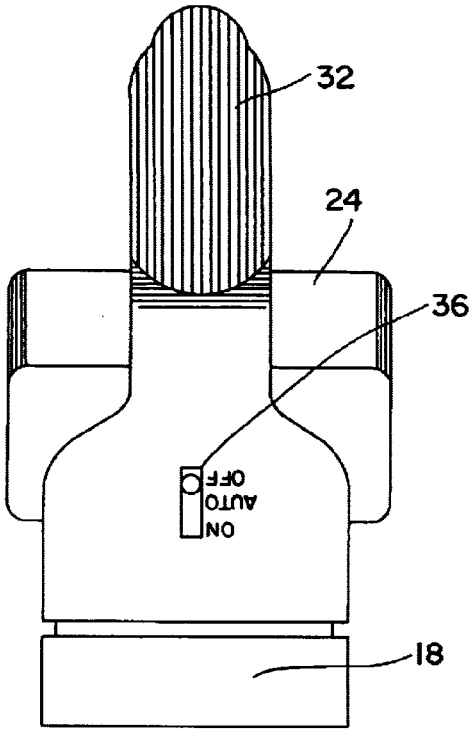
FIG. 3 is a top view of the structure illustrated in FIG. 1.
Figure 4:
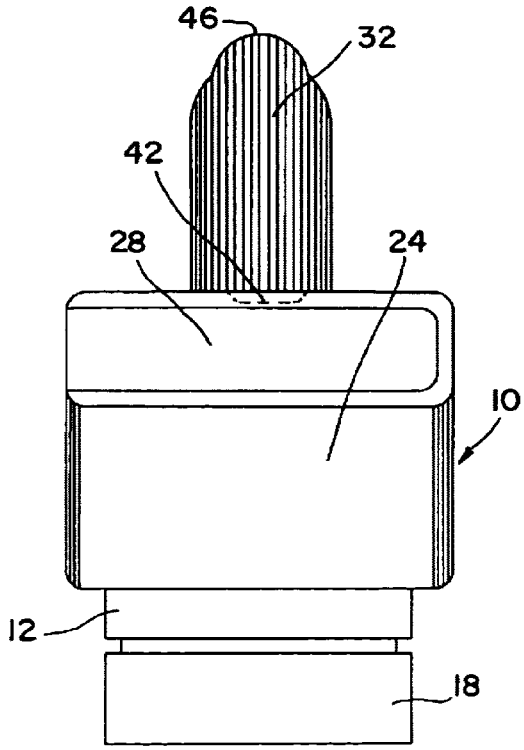
FIG. 4 is a bottom view of the structure illustrated in FIG. 1.
Figure 5:
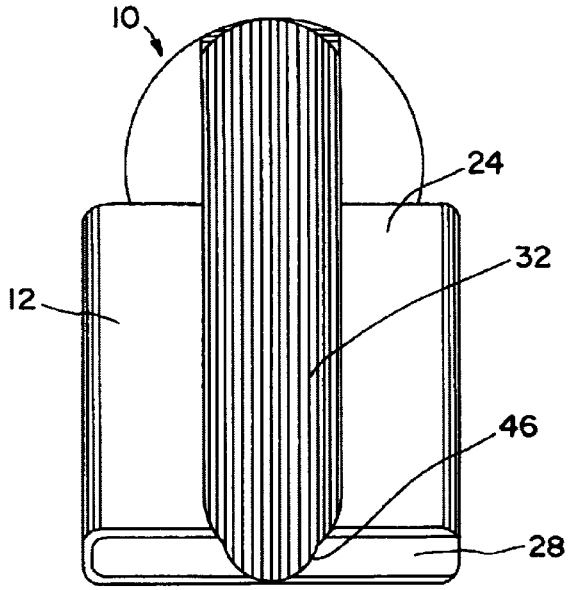
FIG. 5 is a back view of the structure illustrated in FIG. 1.

Referring to the drawings, the present invention is shown embodied in a tactical light, generally designated 10, particularly adapted for use by duly authorized armed civilians, police officers and military personnel, although it will be understood that tactical lights embodying the present invention are applicable for use by others. The tactical light 10 includes a body 12 which may be formed of plastic or other suitable material having sufficient strength to withstand the forces exerted thereon. The body 12 defines a chamber 14 open at the front end of the body and adapted to receive a pre-focused lamp 16. The chamber 14 is closed by a screw-on lens cap 18 which threadably engages the open end of the body, the lens cap 18 being disposed in sealing relationship with respect to the body through the agency of a conventional O-ring seal 20, whereby the lens cap also serves to retain a lens 22.

The body 12 also defines a compartment 24 adapted to receive conventional batteries 26, as for example four AA batteries. The compartment 24 is maintained in a water tight condition through the agency of a slide-off cover 28 as illustrated in the drawings.

The top of the body 12 is provided with a flat surface 30 which merges with an angularly disposed curved cantilever handle 32 projecting angularly downwardly from the flat top 30 of the body at a preferred angle of approximately 27 degrees. As shown in FIG. 1, the body 12 defines an open ended recess 34 adapted to accommodate the fingers of the user of the tactical light 10. An off-auto-on switch 36 is mounted on the flat top of the body while a water tight touch pad switch 38 is mounted on the inner surface of the handle. A high density foam pad 40 lines the inside curve of the handle, and if desired, the body may be provided with a recess 42, such as a 1/16 inch recess, to facilitate supporting the knuckles of the user's support hand. Also, the handle 32 is preferably provided with balancing counter weights 44, such as 150 gram counter weights, to balance the weight of the lamp and the batteries.

As shown in the drawings, the free end of the handle 32 may be configured to define a tactical pressure point 46 on the free end of the handle. The pressure point 46 may be utilized to subdue a suspected perpetrator of a crime, for example, by pressing the tactical pressure point 46 against the temple of such a perpetrator.

Figure 6:
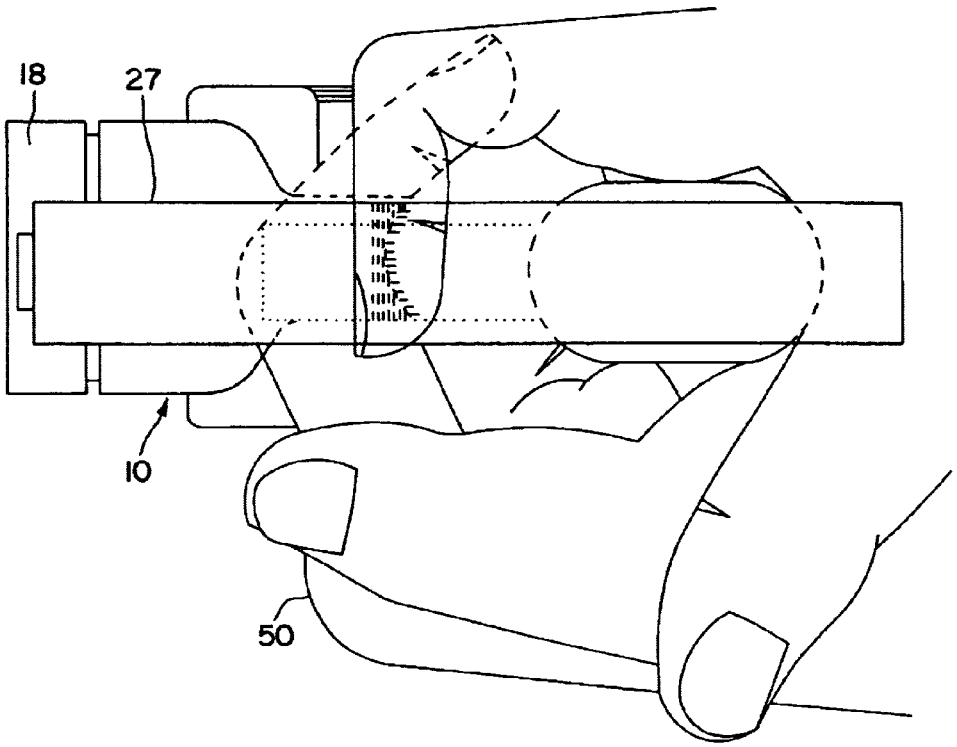
FIG. 6 is a top view of the tactical light illustrated in FIG. 1 showing the same with a pistol and the use of a full combat grip.
Figure 7:
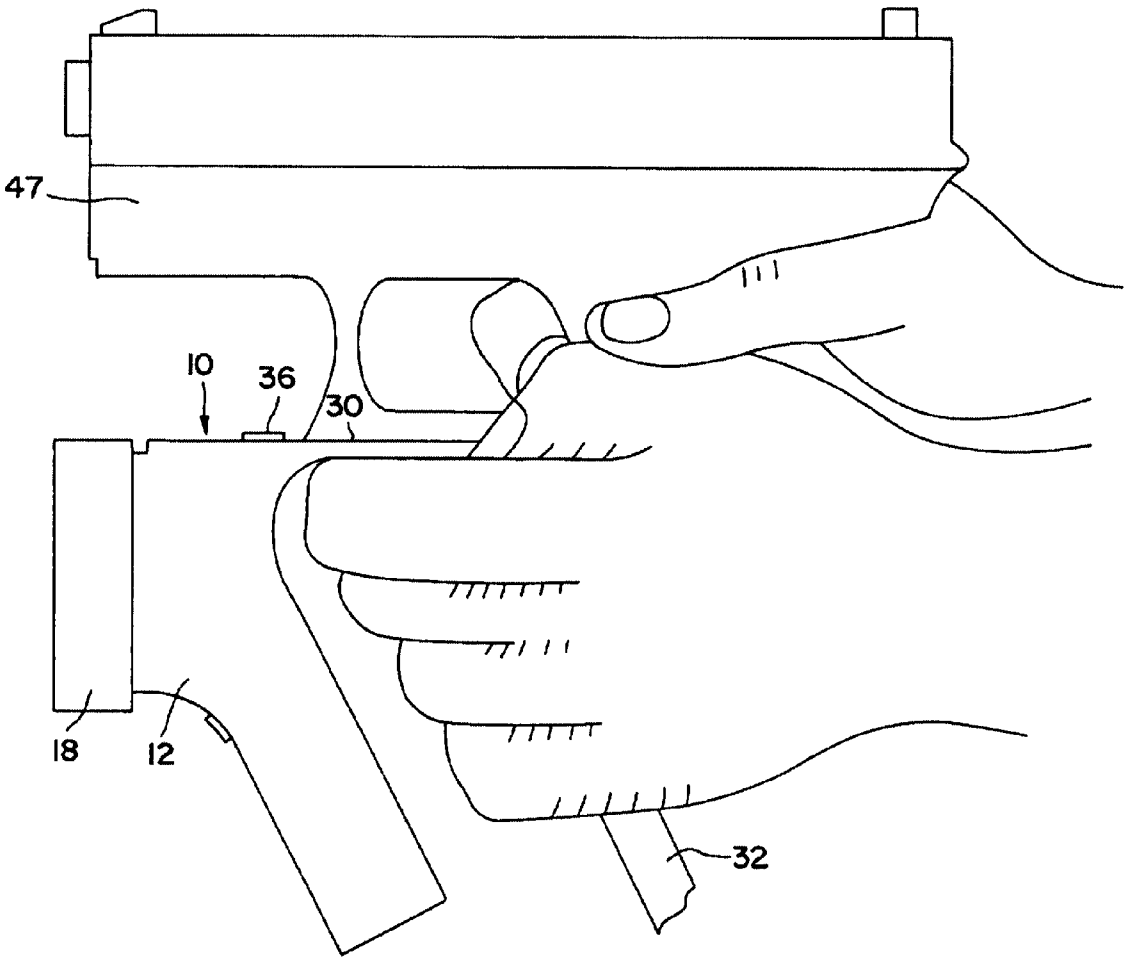
FIG. 7 is a view of one side of the structure illustrated in FIG. 6.
Figure 8:
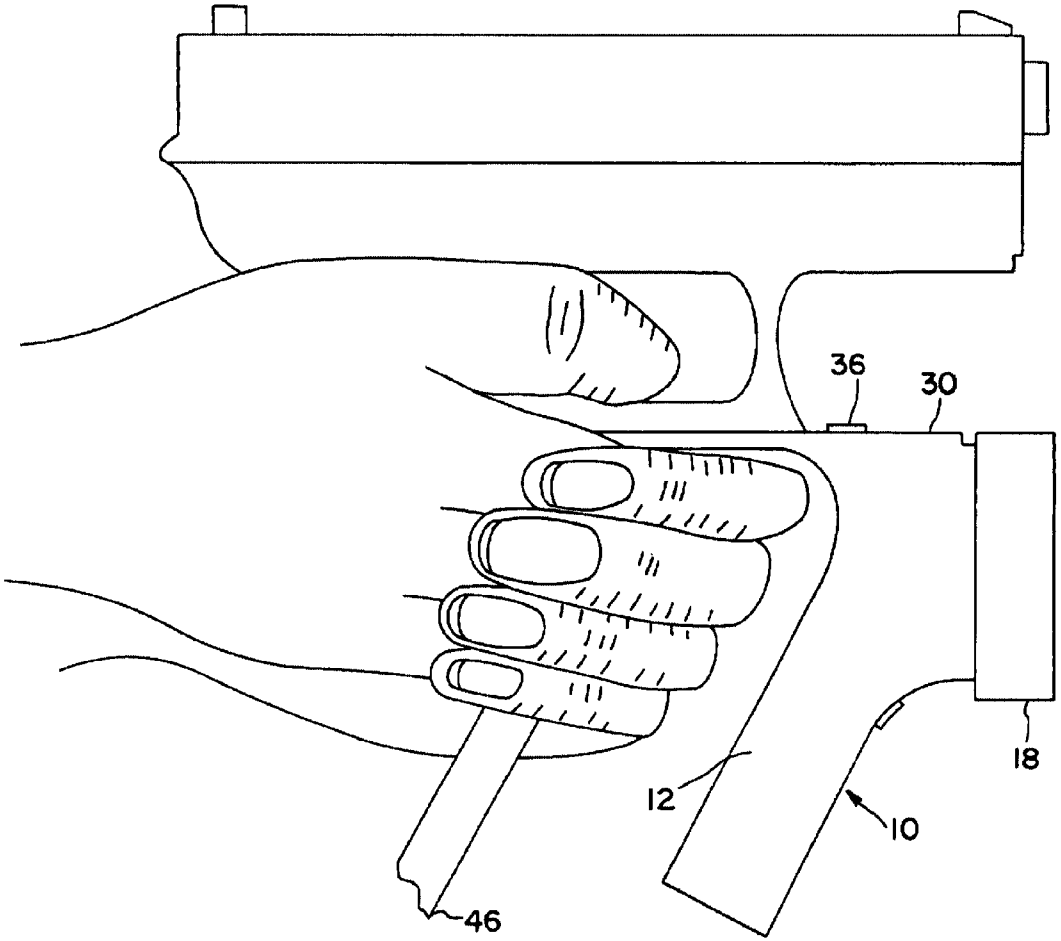
FIG. 8 is a view of the other side of the structure illustrated in FIG. 6.

FIGS. 6, 7 and 8 illustrate the manner in which tactical lights embodying the present invention may be utilized in conjunction with a conventional pistol, a conventional Glock 27 pistol 47 being depicted for illustrative purposes. It will be understood, of course, that tactical lights embodying the present invention may be utilized with a wide variety of pistols, revolvers and other firearms.

As shown in FIGS. 6, 7 and 8, the strong hand 49 of the user of the tactical light grips the pistol while the support hand 50 of the user grips the tactical light, a full combat grip using the tactical light being illustrated whereby the pistol is supported on the top edge of the tactical light. Thus the touch pad light switch 38 may be activated by squeezing with the support hand index finger while the handle angle keeps the axis of the light beam in the desired position relative to the muzzle and sights of the pistol, for example, parallel with the axis of the barrel of the weapon.

Figure 9:
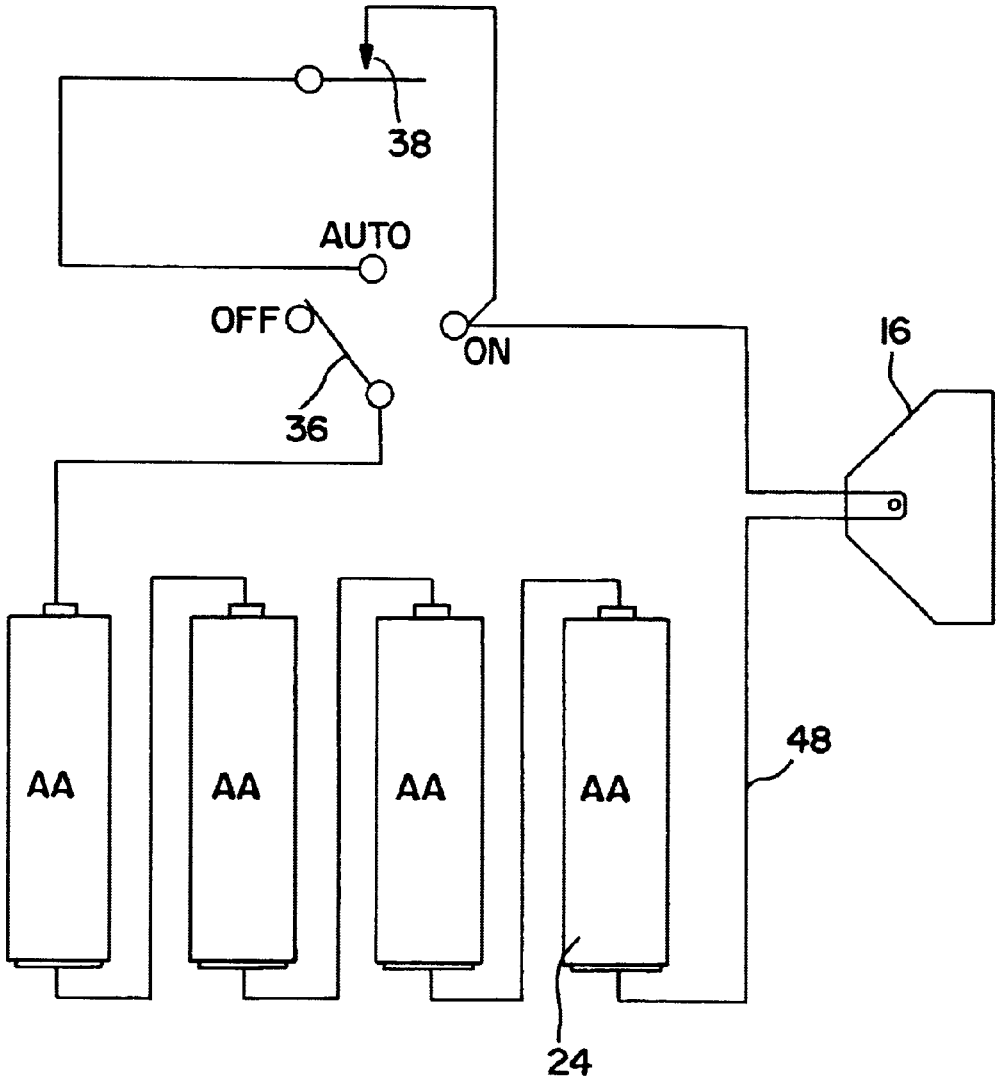
FIG. 9 is a schematic diagram of the electrical circuitry embodied in the tactical light illustrated in FIG. 1.

FIG. 9 is a schematic diagram illustrating the electrical circuitry 48 whereby the pre-focused lamp 16 may be energized through the agency of the four batteries 26 connected in series, the energization of the lamp 16 being controlled by the off-auto-on selector switch 36 and the touch pad switch 38 which may be opened and closed in a conventional manner.

From the foregoing, it will be appreciated that tactical lights embodying the present invention allow for two-hand full combat grips on pistols, revolvers and other firearms while using such lights. It is possible for users to open doors, subdue a suspected perpetrator or handcuff a suspected perpetrator without releasing the tactical light. Moreover the tactical light can be used with one hand or two hand full combat grips. No additional holsters are required since the handle 32 may be simply slipped over a carrying belt. No keepers or lanyards are required. It will also be understood it is not necessary to change the grip in order to use the light. No prior art thumb buttons are required which must be pressed when utilizing the laser technique, and tactical lights embodying the present invention do not disrupt the grip and do not require the wrists to be crossed as in the Harris technique. Tactical lights embodying the present invention utilize standard batteries, and the tactical lights are water tight and body fluid tight so that they can be easily washed and disinfected.

It will be also understood that it is not necessary to change the weapon drawing technique at night, the support hand meets the gun hand, and both the tactical light and the gun are pushed toward the target at the same time. Tactical lights embodying the present invention can be turned on and off simply by pressing the support hand index finger to engage the touch pad switch 38. Thus the tactical light is only energized when the user wishes it to be energized, and the user may go to a full combat grip in record time. Moreover tactical reloads may be effected without removing the light from the users hand. Fast shut-off is available when avoiding mirror or other reflective surface flash back while clearing a premise.

While a preferred embodiment of the invention has been illustrated and described, it will be understood that various changes and modifications may be made without departing from the spirit of the invention.

What is claimed is:

1. A tactical light particularly adapted to for use with a pistol or revolver using a two-handed grip, said tactical light comprising, in combination, a body defining a chamber open at a front end of the body and adapted to receive a lamp, said chamber being enclosed by a lens cap which engages the front end of the body, the lens cap being disposed in sealing relationship with respect to the body through agency of a seal, said body defining a compartment adapted to receive conventional batteries, said compartment being maintained in a water tight condition by a cover, said body being provided with a top surface which is held tight to a bottom side of a trigger guard of the pistol or revolver and which merges with an angularity disposed curved cantilever handle projecting angularly downwardly from the top surface of the body at a preferred angle of approximately 27 degrees adjacent a grip of the pistol or revolver, said body defining an open ended recess adapted to accommodate fingers of a user of the light, an off-auto-on switch mounted on the top surface of the body, a water tight touch pad switch mounted on an inner surface of said handle, a high density foam pad lining the inner surface of the handle, said body being provided with a recess to facilitate supporting knuckles of a user's support hand, said handle being provided with balancing counter weights to balance a weight of the lamp and batteries.

2. The combination as set forth in claim 1, said body being formed of plastic.

3. The combination as set forth in claim 1, the top surface of the body being provided with a flat surface.

4. The combination as set forth in claim 1, engerization of said lamp being controlled by said off-auto-on switch.

5. In combination with a pistol or revolver a tactical light enabling a two-handed grip of the pistol or revolver, said tactical light comprising, in combination, a body defining a chamber open at a front end of the body and adapted to receive a pre-focused lamp, said chamber being enclosed by a lens cap which readily engages the front end of the body, the lens cap being disposed in sealing relationship with respect to the body through agency of an o-ring seal, said body defining a compartment adapted to receive conventional batteries, said compartment being maintained in a water tight condition by a cover, said body being provided with a top surface which is held tight to a bottom side of a trigger guard of the pistol or revolver and which merges with an angularity disposed curved cantilever handle projecting angularly downwardly from the top surface of the body at a preferred angle of approximately 27 degrees adjacent a grip of the pistol or revolver, said body defining an open ended recess adapted to accommodate fingers of a user of the light, an off-auto-on switch mounted on the top surface of the body, a water tight touch pad switch mounted on an inner surface of said handle, a high density foam pad lining the inner surface of the handle, said body being provided with a recess to facilitate supporting knuckles of a user's support hand, said handle being provided with balancing counter weights to balance a weight of the lamp and batteries a free end of the handle being configured to define a tactical pressure point on the free end of the handle.

6. The combination as set forth in claim 5, said body being formed of plastic.

7. The combination as set forth in claim 6, the top surface of the body being provided with a flat surface.

8. The combination as set forth in claim 7, engerization of said lamp being controlled by said off-auto-on switch.

9. A tactical light particularly adapted to for use with a pistol or revolver using a two-handed grip, said tactical light comprising, in combination, a body defining a chamber open at a front end of the body and adapted to receive a lamp, said chamber being enclosed by a lens cap which engages the front end of the body, said body defining a compartment adapted to receive conventional batteries, said body being provided with a top surface which is held tight to a bottom side of a trigger guard of the pistol or revolver and which merges with an angularity disposed curved cantilever handle projecting angularly downwardly from the top surface of the body adjacent a grip of the pistol or revolver, said body defining an open ended recess adapted to accommodate fingers of a user of the light, and an off-auto-on switch mounted on the body.

* * * * *